US009660343B2

(12) United States Patent
Ryu et al.

(10) Patent No.: US 9,660,343 B2
(45) Date of Patent: May 23, 2017

(54) ANTENNA AND COMMUNICATION DEVICE COMPRISING SAME

(71) Applicant: EMW CO., LTD., Incheon (KR)

(72) Inventors: Byung Hoon Ryu, Seoul (KR); Won Mo Sung, Gyeonggi-do (KR); Ui Sheon Kim, Gyeonggi-do (KR); Yeon Sik Yu, Gyeonggi-do (KR)

(73) Assignee: EMW CO., LTD., Incheon (KR)

( * ) Notice: Subject to any disclaimer, the term of this patent is extended or adjusted under 35 U.S.C. 154(b) by 0 days.

(21) Appl. No.: 14/404,941

(22) PCT Filed: May 31, 2013

(86) PCT No.: PCT/KR2013/004743
§ 371 (c)(1),
(2) Date: Dec. 1, 2014

(87) PCT Pub. No.: WO2013/180479
PCT Pub. Date: Dec. 5, 2013

(65) Prior Publication Data

US 2015/0123855 A1 May 7, 2015

(30) Foreign Application Priority Data

Jun. 1, 2012 (KR) ..... 10-2012-0059243

(51) Int. Cl.
*H01Q 7/00* (2006.01)
*H01Q 1/24* (2006.01)
(Continued)

(52) U.S. Cl.
CPC ..... *H01Q 7/00* (2013.01); *H01Q 1/24* (2013.01); *H01Q 1/243* (2013.01); *H01Q 1/48* (2013.01);
(Continued)

(58) Field of Classification Search
CPC ..... H01Q 5/328; H01Q 5/335; H01Q 1/243; H01Q 1/48; H01Q 7/005; H01Q 21/30
(Continued)

(56) References Cited

U.S. PATENT DOCUMENTS 5,457,470 A 10/1995 Hai et al.
6,266,020 B1 * 7/2001 Chang ..... H01Q 1/243 343/702
(Continued)

FOREIGN PATENT DOCUMENTS

CN 104488138 A 4/2015
EP 1280232 A1 1/2003
(Continued)

OTHER PUBLICATIONS

International Search Report for PCT/KR2013/004743.
(Continued)

*Primary Examiner* — Hoang Nguyen
(74) *Attorney, Agent, or Firm* — The PL Law Group, PLLC

(57) ABSTRACT

Disclosed are an antenna and a communication device including the same. The antenna includes a feeder, a first loop antenna that has an end connected to the feeder and the other end connected to a ground, and a second loop antenna that has an end connected to the feeder and the other end connected to the ground, and has an electrical length different from that of the first loop antenna, wherein an impedance matching line having a discontinuously different line width is formed in a partial area of the first loop antenna.

11 Claims, 21 Drawing Sheets

(51) Int. Cl.

| | |
|---|---|
| ***H01Q 21/30*** | (2006.01) |
| ***H01Q 5/328*** | (2015.01) |
| ***H01Q 5/335*** | (2015.01) |
| ***H01Q 1/48*** | (2006.01) |

(52) U.S. Cl.
CPC ..... *H01Q 5/328* (2015.01); *H01Q 5/335* (2015.01); *H01Q 7/005* (2013.01); *H01Q 21/30* (2013.01)

(58) Field of Classification Search
USPC ..... 343/702, 751, 848
See application file for complete search history.

(56) References Cited

U.S. PATENT DOCUMENTS

| | | | | |
|---|---|---|---|---|
| 8,228,251 | B1 * | 7/2012 | Behdad | H01Q 7/00 343/742 |
| 8,344,950 | B2 * | 1/2013 | Su | H01Q 3/24 343/700 MS |
| 8,638,262 | B2 * | 1/2014 | Arkko | H01Q 1/243 343/702 |
| 8,854,273 | B2 * | 10/2014 | Li | H01Q 5/35 343/741 |
| 2007/0285331 | A1 * | 12/2007 | Sarabandi | H01Q 7/00 343/866 |
| 2009/0009415 | A1 | 1/2009 | Tanska et al. | |

FOREIGN PATENT DOCUMENTS

| | | | |
|---|---|---|---|
| EP | 2182577 | A1 | 5/2010 |
| EP | 2251930 | A1 | 11/2010 |
| EP | 2388858 | A1 | 11/2011 |
| EP | 2846402 | A1 | 3/2015 |
| JP | 2003-37861 | A | 2/2003 |
| JP | 2005-333244 | A | 12/2005 |
| JP | 2015-521451 | A | 7/2015 |
| KR | 10-2001-0053424 | A | 6/2001 |
| KR | 10-2007-0001175 | A | 1/2007 |
| KR | 10-2009-0104333 | A | 10/2009 |
| KR | 10-2011-0109383 | A | 10/2011 |
| KR | 10-1323134 | B1 | 10/2013 |
| WO | 2010137061 | A1 | 12/2010 |
| WO | 2011000416 | A1 | 1/2011 |
| WO | 2011159037 | A2 | 12/2011 |
| WO | 2013/180479 | A1 | 12/2013 |

OTHER PUBLICATIONS

Sang Heun Lee et al., Multi-band Coupled Feed Loop Antenna for Mobile Handset, Asia-Pacific Microwave Conference 2009.

Office action issued on Jan. 15, 2016 from Japan Patent Office in a counterpart Japan Patent Application No. 2015-514903 (all the cited references are listed in this IDS.) (English translation is also submitted herewith.)

European Search Report for EP13797322. from European patent office in a counterpart European patent application.

* cited by examiner

ANTENNA AND COMMUNICATION DEVICE COMPRISING SAME

This application is a National Stage entry from International Application No. PCT/KR2013/004743, filed 31 May 2013, which claims priorities to and the benefit of Korean Patent Application No. 10-2012-0059243, filed 1 Jun. 2012, the disclosure of which is incorporated herein by reference in its entirety.

BACKGROUND

1. Field of the Invention

The present invention relates to an antenna and a communication device including the same.

2. Discussion of Related Art

Any device that performs wireless communication requires an antenna. The antenna is not operated in all frequency bands but is resonated only in a fixed frequency band, and therefore, in order to provide a specific communication service in a communication device, the antenna should be designed to be resonated in a frequency band for the specific communication service.

However, in recent years, according to the advent of various communication service bands, an operating frequency band required for the antenna has been gradually increased. That is, in order for a single communication device to cover various communication services, the bandwidth of the antenna may be expanded or the antenna may be designed to be operated in multiple bands.

In addition, according to the miniaturization of the communication device, an inverted F-type antenna has been widely used in a compact device such as a mobile communication terminal, a smart phone, or the like. This is because, using the inverted F-type antenna, it is possible to cover a required existing service band and obtain appropriate excellent performance.

However, there are the following problems in the case of using the inverted F-type antenna.

First, in order for the inverted F-type antenna to be designed to be operated in multiple bands, a change is given to a pattern shape and methods of designing the inverted F-type antenna are different for each antenna designer, and therefore there is a huge variety of the pattern shapes of the completed antenna. That is, there is no established single design method.

Second, in order for the inverted F-type antenna to be included in the communication device, a ground area to exist below the antenna should be removed. Otherwise, the performance of the antenna is not properly exhibited. However, when partially removing the ground area owing to a space for the antenna, there is a problem in that a display area cannot be expanded in the partially removed ground area. This is because the ground area should exist below the display area. In other words, as shown in (a) of FIG. 1, in order for a display area 2 of a communication device 1 to be expanded to the entire surface, a ground plane should be formed over the entire surface, and therefore there is no space in which the inverted F-type antenna is formed. As shown in (b) of FIG. 1, in order to ensure a space 3 in which the inverted F-type antenna is formed in the communication device 1, the ground plane should be partially removed, and therefore there is a problem in that the display area 2 is reduced. Because of this dilemma, conventionally, a communication device having the structure shown in (b) of FIG. 1 was manufactured in most cases.

Thus, in recent years, a simple and clear antenna design method has been required, and development of an antenna that can exhibit excellent performance even in a full ground state in which the ground plane is not removed has been highlighted as an urgent task.

SUMMARY OF THE INVENTION

The present invention is directed to provide an antenna whose simple and clear design is possible.

The present invention is directed to provide an antenna that can obtain excellent performance even without removing a ground plane of a main circuit included in a communication device.

According to an aspect of the present invention, there is provided an antenna including: a feeder; a first loop antenna that has an end connected to the feeder and the other end connected to a ground; and a second loop antenna that has an end connected to the feeder and the other end connected to the ground, and has an electrical length different from that of the first loop antenna, wherein an impedance matching line having a discontinuously different line width is formed in a partial area of the first loop antenna.

Here, the ground may be provided in the form of a full ground in which the ground is overlapped with the first and second loop antennas.

Also, at least any one of the first and second loop antennas may be formed in a rear cover of a communication device.

Also, at least any one of the first and second loop antennas may be formed on an inner side surface of a battery cover.

Also, the impedance matching line may be formed in an area in which the impedance matching line is not overlapped with a deformed component.

Also, the impedance matching line may be formed at a point at which electric field or magnetic field distribution is a maximum within the first and second loop antennas.

Also, the antenna may further include: a first inductor that is interposed between the end of the first loop antenna and the feeder; and a second inductor that is interposed between the other end of the first loop antenna and the ground and has an inductance value different from that of the first inductor, wherein the impedance matching line is formed closer to one whose inductance value is larger than the other of the first and second inductors within the first loop antenna.

Also, the antenna may further include: a first inductor that is interposed between the end of the first loop antenna and the feeder; and a second inductor that is interposed between the other end of the first loop antenna and the ground and has the same inductance value as that of the first inductor, wherein the impedance matching line is formed in an area including an intermediate point of the first loop antenna.

Also, the antenna may further include: a first inductor that is interposed between the end of the first loop antenna and the feeder, wherein the impedance matching line is formed closer to the one end than the other end between the one end and other ends of the first loop antenna.

Also, the antenna may further include: a second inductor that is interposed between the other end of the first loop antenna and the ground, wherein the impedance matching line is formed closer to the other end than the one end between the one end and other ends of the first loop antenna.

Also, a gap coupling structure may be included in the impedance matching line.

Also, a slot may be included in the impedance matching line.

Also, the feeder may include a branch line that branches the first loop antenna and the second loop antenna, a first feeder line that has a loop structure having an end connected to the branch line and the other end connected to the ground, and a second feeder line that has a loop structure having an end connected to a main circuit unit and the other end thereof to the ground, and is inductively coupled with the first feeder line.

According to another aspect of the present invention, there is provided a communication device including the antenna.

BRIEF DESCRIPTION OF THE DRAWINGS

The above and other objects, features and advantages of the present invention will become more apparent to those of ordinary skill in the art by describing in detail exemplary embodiments thereof with reference to the accompanying drawings, in which.

DETAILED DESCRIPTION OF EXEMPLARY EMBODIMENTS

Example embodiments of the present invention are disclosed herein. However specific structural and functional details disclosed herein are merely representative for purposes of describing example embodiments of the present invention, and example embodiments of the present invention may be embodied in many alternate forms and should not be construed as being limited to example embodiments of the present invention set forth herein. It should be understood, however, that there is no intent to limit the invention to the particular forms disclosed, but on the contrary, the invention is to cover all modifications, equivalents, and alternatives falling within the spirit and scope of the invention.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises," "comprising," "includes," and/or "including," when used herein, specify the presence of stated features, integers, steps, operations, elements, components, and/or groups thereof, but do not preclude the presence or addition of one or more other features, integers, steps, operations, elements, components, and/or groups thereof.

Hereinafter, preferred embodiments of the present invention will be described in detail with reference to the accompanying drawings. However, when it is determined that the detailed description of the related art would be obscure the gist of the present invention, the description thereof will be omitted.

Figure 1A:
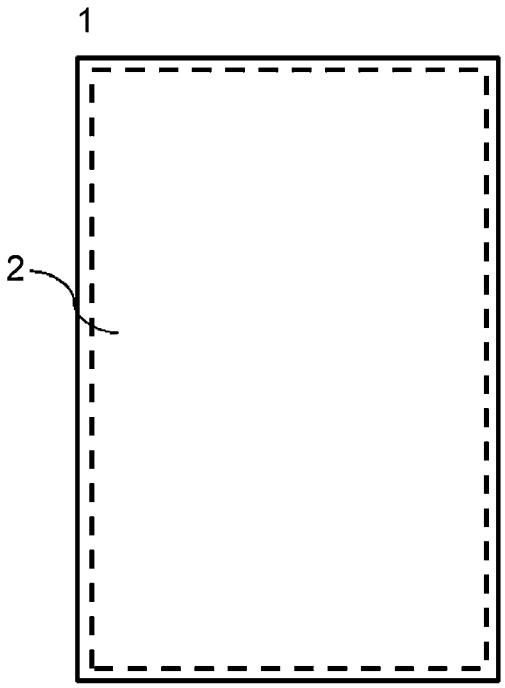
FIGS. 1A and 1B are views showing a display area and an antenna area of a communication device according to the related art.
Figure 1B:
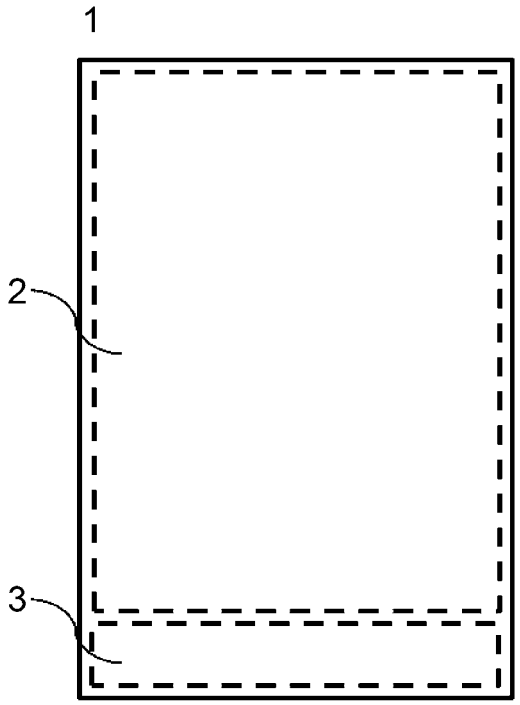
Figure 2:
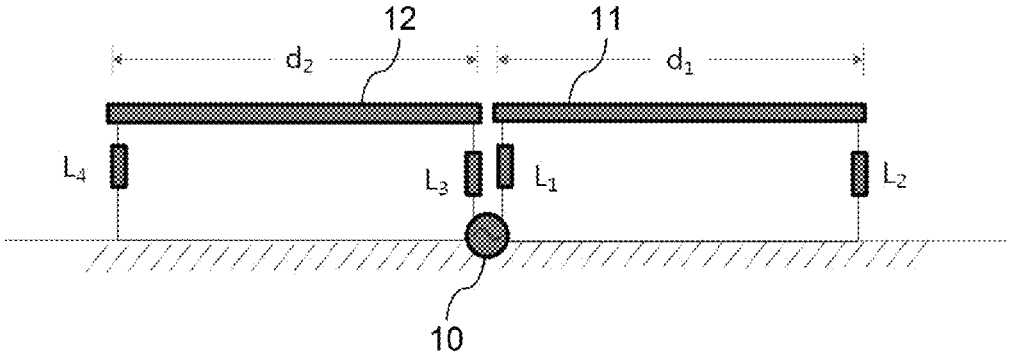
FIG. 2 is a view showing an antenna according to an embodiment of the present invention.

FIG. 2 is a view showing an antenna according to an embodiment of the present invention.

Referring to FIG. 2, the antenna according to an embodiment of the present invention includes a feeder 10, a first loop antenna 11, and a second loop antenna 12. The first loop antenna 11 has an end connected to the feeder 10 and the other end connected to a ground. The second loop antenna 12 also has an end connected to the feeder 10 and the other end connected to the ground, but has an electrical length different from that of the first loop antenna. That is, the electrical length considering a physical length d1 of the first loop antenna 11 and inductance components L1 and L2 of both ends of the first loop antenna 11 is different from the electrical length considering a physical length d2 of the second loop antenna 12 and inductance components L3 and L4 of both ends of the second loop antenna 12. When the electrical lengths of the first and second loop antennas 11 and 12 are the same, a current is offset, and therefore the first and second loop antennas 11 and 12 are not operated as an antenna. Meanwhile, here, the expression of the inductance components L1, L2, L3, and L4 may refer to a structure in which an inductor is directly connected, but the present invention is not limited thereto. For example, the inductance components L1, L2, L3, and L4 may be inductance components generated by a length component of a conductor end.

Figure 3:
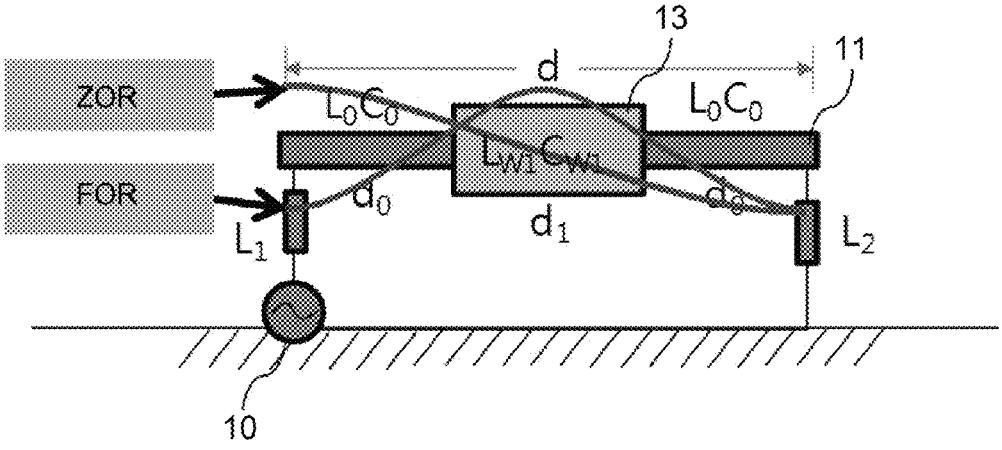
FIG. 3 is a view showing a state in which only a first loop antenna is separated from an antenna according to an embodiment of the present invention.

FIG. 3 is a view showing a state in which only a first loop antenna is separated from an antenna according to an embodiment of the present invention.

With reference to FIG. 3, an operating principle of the first loop antenna 11 will be described. When An electrical length considering a physical length d of the first loop antenna and inductance components L1 and L2 of both ends of the first loop antenna is close to $\lambda/2$, a maximum current intensity is distributed at both ends of the loop, and zeroth-order resonance (ZOR) characteristics in which the current intensity is a minimum may be obtained at the center of the loop. Meanwhile, when the electrical length is close to $3\lambda/2$, a maximum point of the current is shown at both ends of the loop and the center thereof, and first-order resonance (FOR) characteristics are exhibited.

Such resonance characteristics may be adjusted by forming the impedance matching line 13 having a discontinuously different line width in a partial area of the first loop antenna 11. As shown in FIG. 3, when the impedance matching line 13 whose line width is discontinuously expanded is formed as shown in FIG. 3, matching characteristics may be changed by an inductance value Lw1 and a capacitance value Cw1 in the impedance matching line 13.

Figure 4:
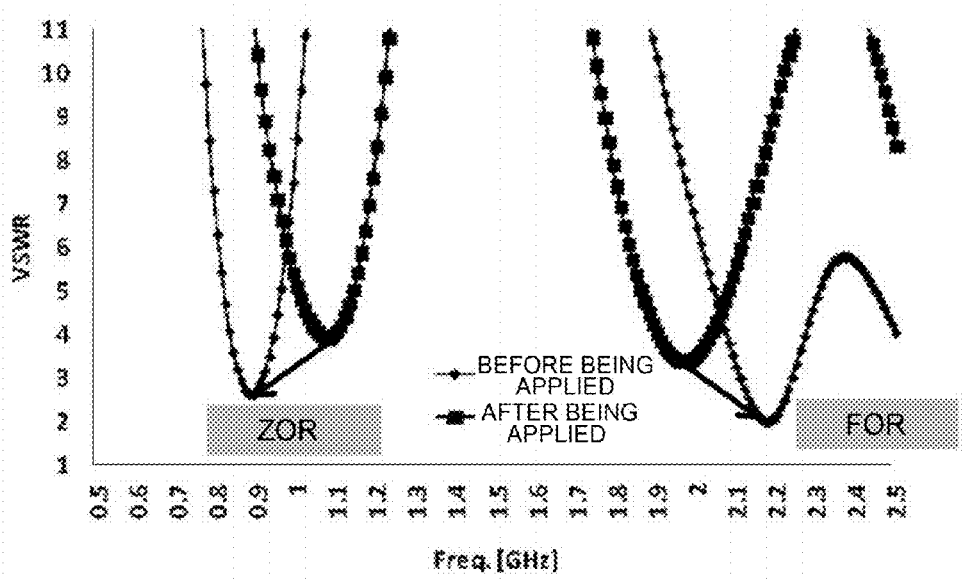
FIG. 4 is a graph showing VSWR of only a first loop antenna from an antenna according to an embodiment of the present invention.

With reference to FIG. 4, a specific example for this will be described. FIG. 4 is a graph showing VSWR of only the first loop antenna 11 from an antenna according to an embodiment of the present invention, and a case in which the impedance matching line 13 is included in at the center of the first loop antenna 11 and a case in which the impedance matching line 13 is not included in at the center of the first loop antenna 11 are respectively shown by graphs.

According to an embodiment of the present invention, by appropriately adjusting the physical length d and the inductance components L1 and L2 of the first loop antenna 11, ZOR characteristics may be obtained in the vicinity of 1.09 GHz and FOR characteristics may be obtained in the vicinity of 1.95 GHz. When simply designing the antenna with only this structure without the impedance matching line 13, resonance characteristics represented as "before being applied" in FIG. 4 may be exhibited.

In such an embodiment, when the impedance matching line 13 whose line width is discontinuously expanded is formed at the center of the first loop antenna 11, impedance matching of the antenna is changed, whereby resonance characteristics are changed. In FIG. 4, a graph represented as "after being applied" shows this.

As shown in FIG. 4, when the impedance matching line 13 is applied, a frequency is moved downwards in the ZOR and a frequency is moved upwards in the FOR. That is, it may be analyzed that, in the ZOR, the frequency is moved downwards along with an increase in a parallel capacitance, and in the FOR, the frequency is moved upwards along with a reduction in a serial inductance. In addition, generally, it can be confirmed that impedance matching characteristics are improved through a reduction in a VSWR value. In this manner, when forming the impedance matching line 13, it is possible to intentionally adjust resonant frequencies, and therefore the antenna can be designed so that resonance characteristics may be obtained in a desired service band. In addition, by improving the matching characteristics, the VSWR value may be reduced.

Meanwhile, the above-described movement of the resonant frequencies and improvement of the matching characteristics may be changed in accordance with a formation area of the impedance matching line 13. This will be described as follows with reference to FIGS. 5 and 6.

Figure 5:
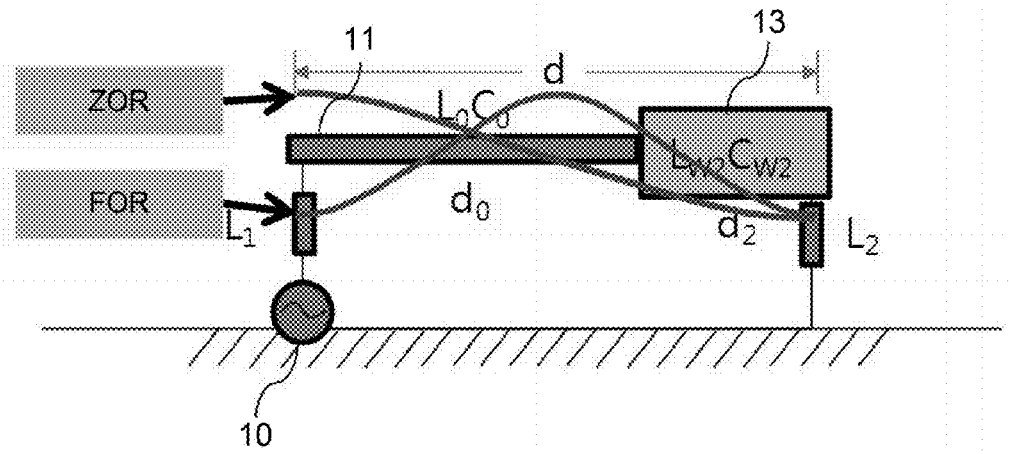
FIG. 5 is a view showing a state in which in which only a first loop antenna is separated from an antenna according to an embodiment of the present invention.
Figure 6:
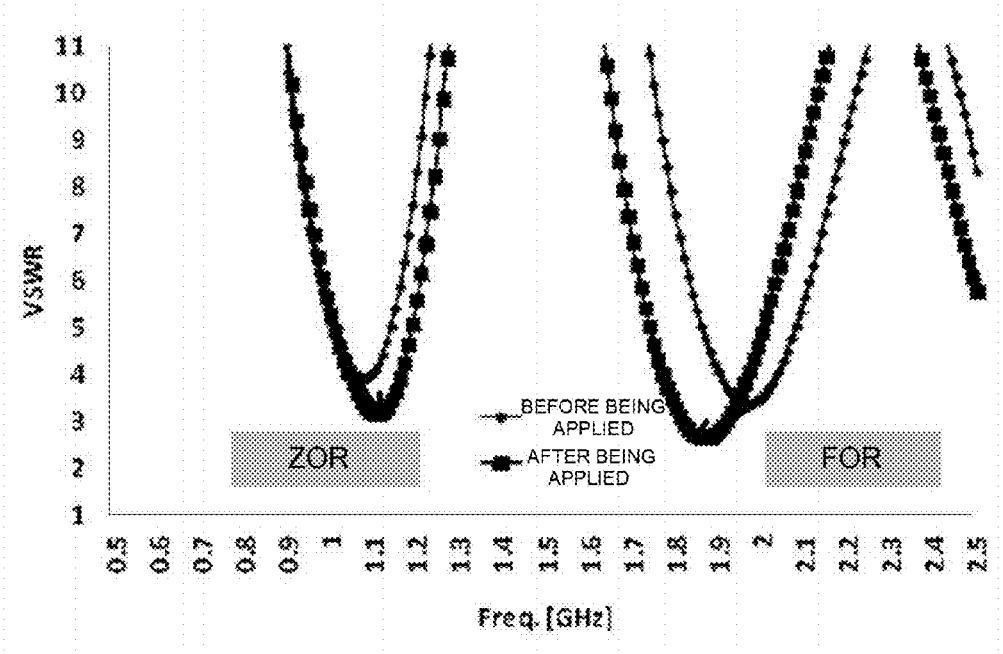
FIG. 6 is a graph showing VSWR of only a first loop antenna from an antenna according to an embodiment of the present invention.

FIG. 5 is a view showing a state in which in which only the first loop antenna 11 is separated from an antenna according to an embodiment of the present invention, and FIG. 6 is a graph showing VSWR of only the first loop antenna 11 from an antenna according to an embodiment of the present invention. In FIGS. 5 and 6, a case in which the impedance matching line 13 is included in the other end of the first loop antenna 11 and a case in which the impedance matching line 13 is not included in the other end of the first loop antenna 11 are respectively shown by graphs.

As in described in the FIGS. 3 and 4, according to an embodiment of the present invention, the antenna may be designed in such a manner that, by appropriately adjusting the physical length d and the inductance components L1 and L2 of the first loop antenna 11, the ZOR characteristics are obtained in the vicinity of 1.09 GHz and the FOR characteristics are obtained in the vicinity of 1.95 GHz. When simply designing the antenna with only this structure without the impedance matching line 13, resonance characteristics represented as "before being applied" in FIG. 6 may be exhibited.

In such an embodiment, when the impedance matching line 13 whose line width is discontinuously expanded is formed at the other end of the first loop antenna 11, whereby resonance characteristics are changed. In FIG. 6, a graph represented as "after being applied" shows this.

The graph shown in FIG. 6 has different characteristics from those of the graph shown in FIG. 4. Referring to FIG. 6, when the impedance matching line 13 is applied, a frequency is moved upwards in the ZOR and a frequency is moved downwards in the FOR. That is, it may be analyzed that, in the ZOR, the frequency is moved upwards along with a reduction in a serial inductance, and in the FOR, the frequency is moved downwards along with an increase in a parallel capacitance. In addition, generally, it can be confirmed that impedance matching characteristics are improved through a reduction in a VSWR value.

As described above, the case in which the impedance matching line 13 is applied based on only the first loop antenna 11 has been described. Hereinafter, a structure including both of the first loop antenna 11 and the second loop antenna 12 will be described.

Figure 7A:
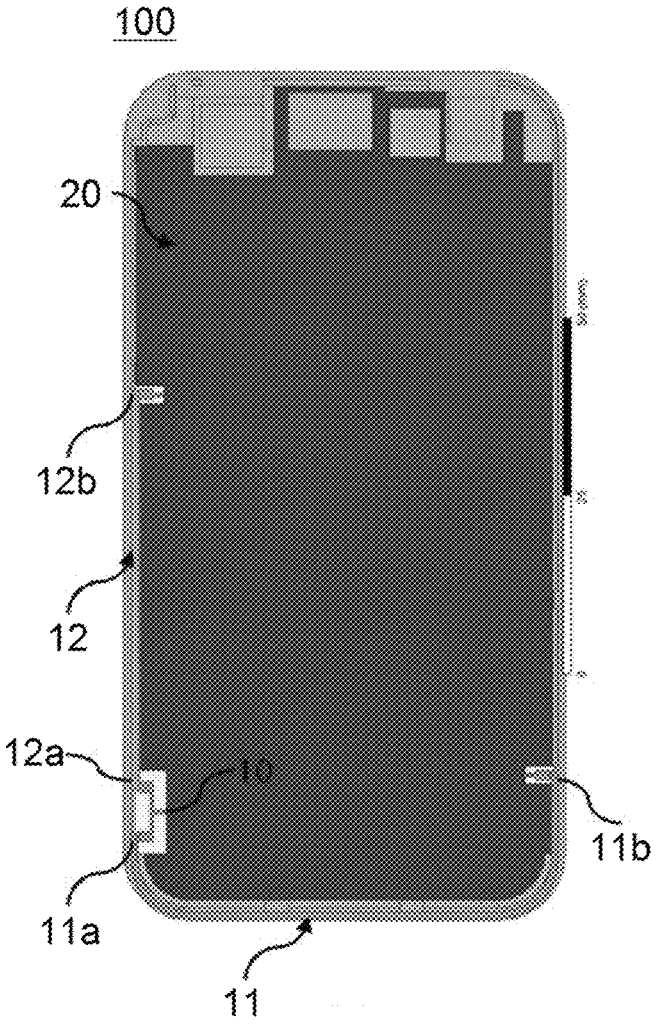
FIGS. 7A and 7B are views showing a state in which an antenna according to an embodiment of the present invention is applied to a communication device.
Figure 7B:
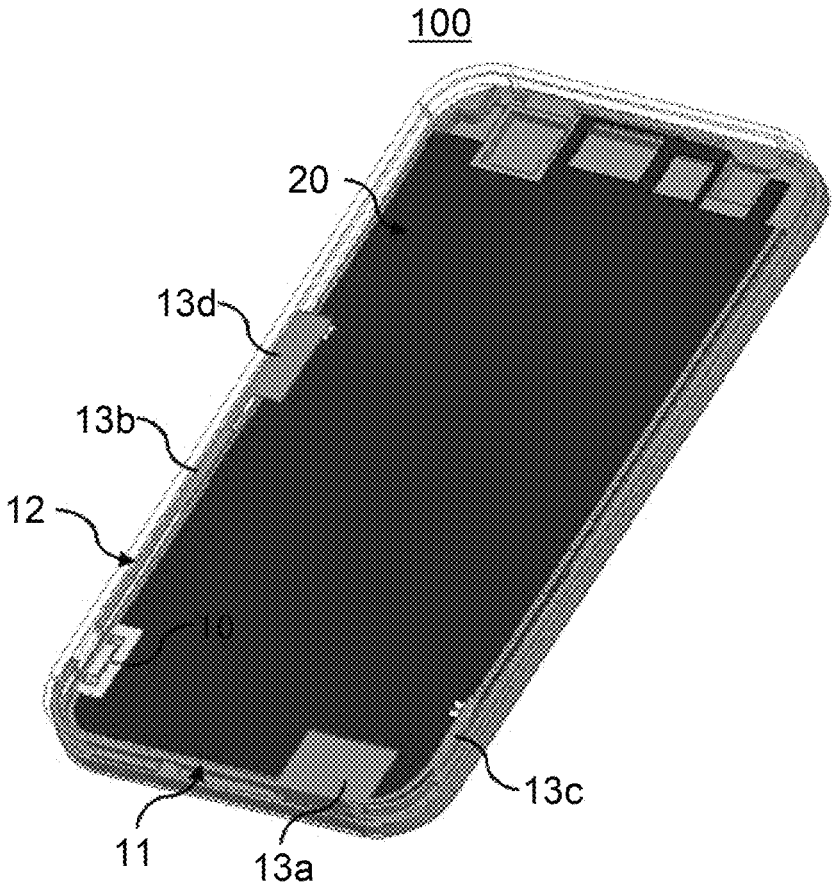

FIG. 7 is a view showing a state in which an antenna according to an embodiment of the present invention is applied to a communication device. In (a) of FIG. 7, a state before applying the impedance matching line 13 is shown, and in (b) of FIG. 7, a state after applying the impedance matching line 13 is shown.

Referring to (a) of FIG. 7, a structure in which an antenna according to an embodiment of the present invention is included in a communication device 100 is shown. A specific state of a main circuit is not shown and only a ground 20 is shown, but obviously, a structure of the main circuit may be further added.

The first loop antenna 11 has an end 11*a* connected to the feeder 10 and the other end 11*b* connected to the ground 20. The second loop antenna 12 has an end 12*a* connected to the feeder 10 and the other end 12*b* connected to the ground 20. The electrical lengths of the first and second loop antennas 11 and 12 are different from each other, and therefore each of the first and second loop antennas 11 and 12 may be operated as a loop antenna while preventing a current from being offset.

As to a state before the impedance matching line 13, that is, only a structure based on (a) of FIG. 7, the first loop antenna 11 has ZOR characteristics in the vicinity of 1.09 GHz and has FOR characteristics in the vicinity of 1.95 GHz. The second loop antenna 12 has ZOR characteristics in the vicinity of 1.85 GHz. In the antenna according to an embodiment of the present invention, such resonance characteristics of the first loop antenna 11 and the second loop antenna 12 are combined to be operated as a whole.

In such a structure, at least one impedance matching line 13 may be formed in a partial area of the first loop antenna 11 or a partial area of the second loop antenna 12. According to the embodiment shown in (b) of FIG. 7, two impedance matching lines 13*a* and 13*c* formed in the first loop antenna 11 and two impedance matching lines 13*b* and 13*d* formed in the second impedance matching line 13 are included in the antenna. As the impedance matching line 13 is included in the antenna, resonant frequencies of the antenna may be adjusted in accordance with a desired service band. Here, the impedance matching line 13 is formed in such a manner that the resonant frequencies of the antenna can be operated even in Long Term Evolution (LTE) band as well as a penta band including GSM quad band and W2100 band. Obviously, the number of the impedance matching lines 13, a location of the impedance matching line 13, a shape thereof, and the like may be merely parameters which can be changed in accordance with a designer's intention, and may not be fixed to the above description.

Figure 8:
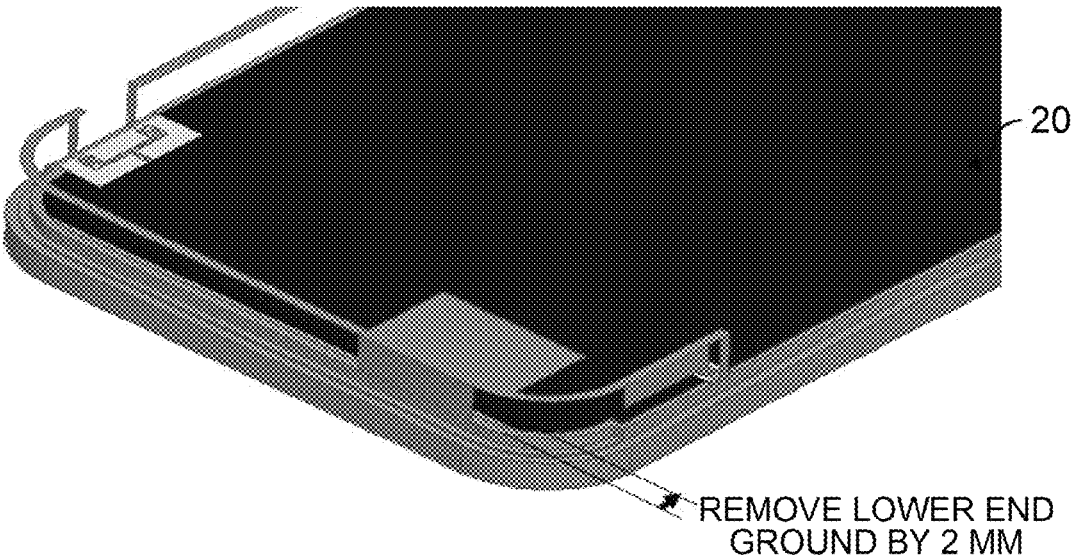
FIG. 8 is a graph obtained by comparing VSWR when an antenna according to an embodiment of the present invention is operated in a full ground state and VSWR when the antenna is operated in a state in which a lower end ground of the antenna is removed by 2 mm.
Figure 8:
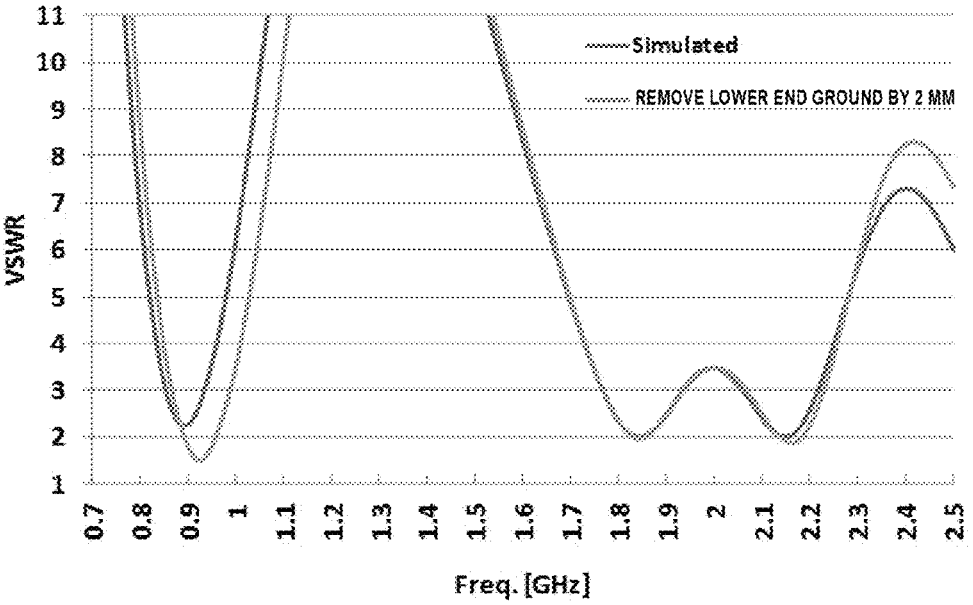

FIG. 8 is a graph obtained by comparing VSWR when an antenna according to an embodiment of the present invention is operated in a full ground state and VSWR when the antenna is operated in a state in which a lower end ground of the antenna is removed by 2 mm.

As shown in FIG. 8, it can be confirmed that, when the antenna according to an embodiment of the present invention is operated in a state in which a lower end ground of the antenna is partially removed, more excellent characteristics are obtained, but even when the antenna is operated in a full ground state, deterioration of performance is minimized. A general inverted F-type antenna is difficult to obtain excellent characteristics of this degree when a ground area of a lower portion of the antenna is in the full ground state. However, according to an embodiment of the present invention, it can be found that even when the ground is formed as is in the lower portion of the antenna, excellent performance may be obtained.

Thus, according to an embodiment of the present invention, the ground 20 may be provided in the form of the full ground so as to be overlapped with the first and second loop antennas 11 and 12. In such a structure, a display area may be expanded to the entire surface, and therefore a limit in the design of the communication device due to the antenna may be minimized.

Meanwhile, although not shown, in the antenna according to an embodiment of the present invention, at least any one of the first and second loop antennas 11 and 12 may be formed in a rear cover of the communication device. Alternatively, the at least any one of the first and second loop antennas 11 and 12 may be formed on an inner side surface of a battery cover. In this case, as a method of manufacturing the antenna, various methods including laser direct structuring (LDS) may be used.

An air gap is formed between the rear cover and the battery cover so that the at least one of the first and second loop antennas 11 and 12 is formed in the rear cover or on the inner surface side of the battery. Due to the air gap, performance of the antenna becomes more excellent. Such characteristics are different from those of the existing inverted F-type antenna, and may be obtained by the structure according to an embodiment of the present invention.

Figure 9:
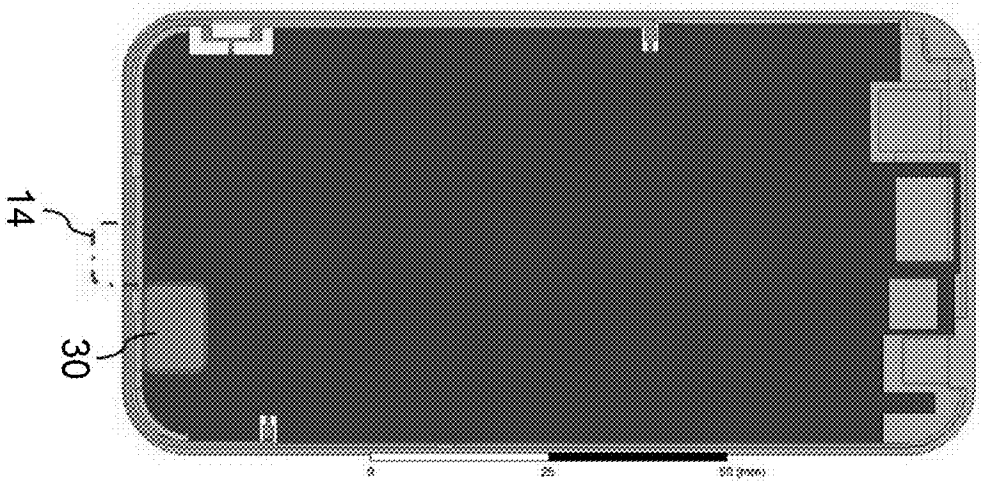
FIG. 9 is a view showing a formation position of an impedance matching line in an antenna according to an embodiment of the present invention.

FIG. 9 is a view showing a formation position of an impedance matching line in an antenna according to an embodiment of the present invention.

There are many cases in which a position of a deformed component 30 such as a speaker or the like is determined in advance by a designer's plan of the communication device. The antenna designer should design the antenna depending on the entire structure of the design of the communication device, and even the position of the deformed component 30 is one of the matters to be taken into account when designing the antenna. Areas in which the impedance matching line 13 is formed are preferably disposed so as not to be overlapped so that deterioration of the performance due to the deformed component 30 is prevented. Referring to FIG. 9, the impedance matching line 13 may be formed in an area 14 in which the impedance matching line 13 is not overlapped with the deformed component 30.

Hereinafter, with reference to FIGS. 10 to 21, a relationship between the position of the impedance matching line 13 and electric field (E-field) or magnetic field (H-field) distribution will be described in detail. According to an embodiment of the present invention based on FIGS. 10 to 21, the structure shown in (a) of FIG. 7 will be described as a basic structure. According to the structure shown in (a) of FIG. 7, the first loop antenna 11 has ZOR characteristics in the vicinity of 1.09 GHz and has FOR characteristics in the vicinity of 1.95 GHz. The second loop antenna 12 has ZOR characteristics in the vicinity of 1.85 GHz. In general, resonance characteristics of the first loop antenna 11 and the second loop antenna 12 are combined to be operated. Thus, hereinafter, an embodiment of the present invention will be described based on 1.09 GHz, 1.85 GHz, and 1.95 GHz, but the resonance frequencies are not necessarily limited thereto. Obviously, the resonance frequencies may be changed in accordance with a designer's intention.

Figure 10:
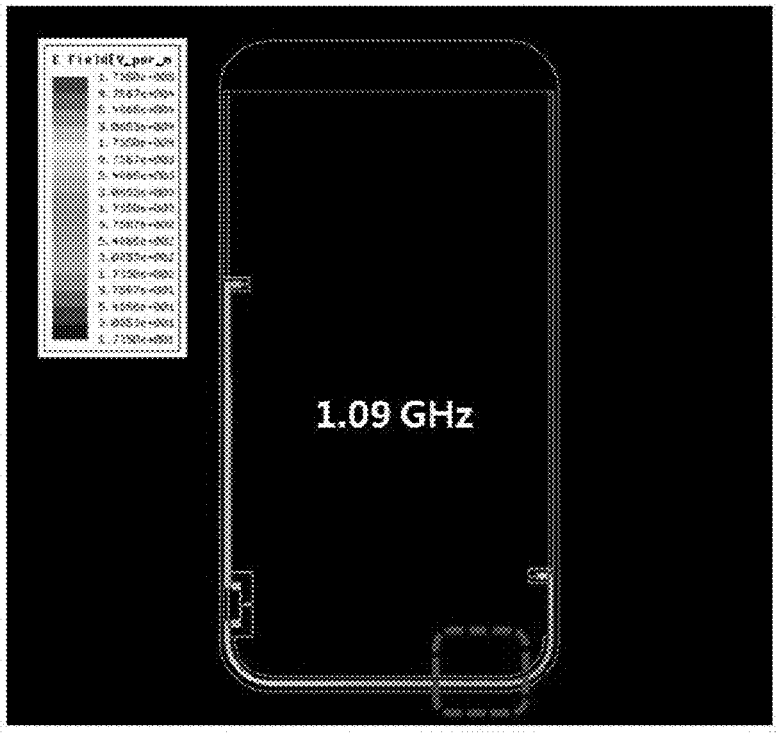
FIG. 10 is a view showing electric field distribution in 1.09 GHz and magnetic field distribution in 1.95 GHz with respect to a structure (a) of FIG. 7.
Figure 10:
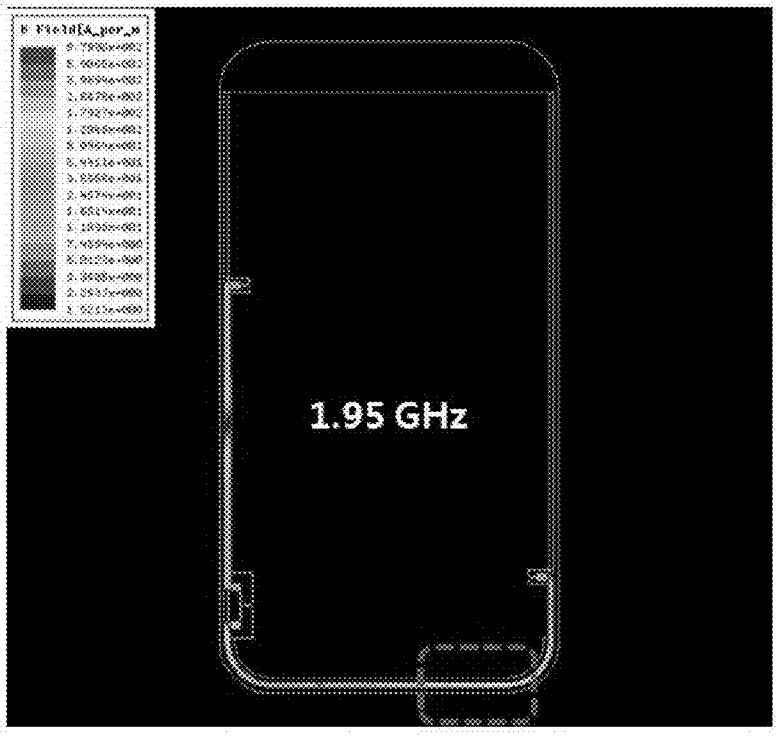

FIG. 10 is a view showing E-field distribution in 1.09 GHz and H-field distribution in 1.95 GHz with respect to a structure (a) of FIG. 7. Referring to FIG. 10, it can be found that areas in which the E-field distribution is a maximum are overlapped.

Figure 11:
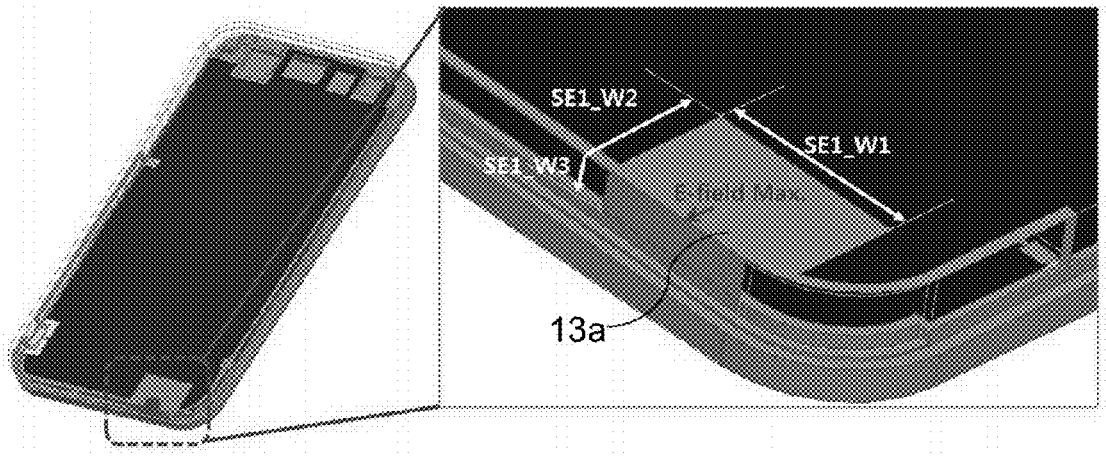
FIG. 11 is a view showing a state in which an impedance matching line is formed in an area verified in FIG. 10.
Figure 12:
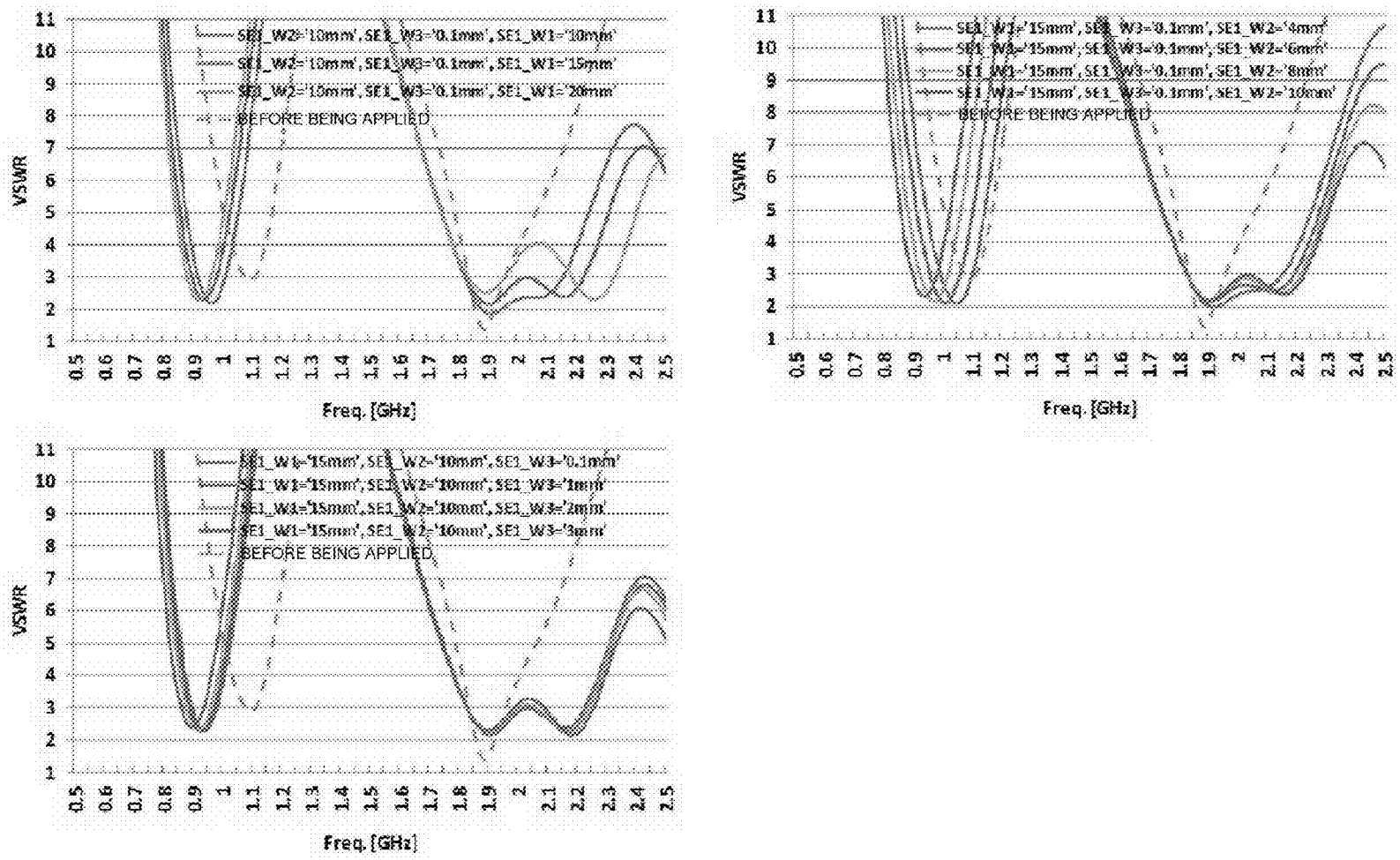
FIG. 12 is a graph showing VSWR that is changed by adjusting values of design parameters of the impedance matching line of FIG. 11.

FIG. 11 is a view showing a state in which an impedance matching line 13*a* is formed in an area verified in FIG. 10. In FIG. 12, by adjusting values of design parameters SE1_W1, SE1_W2, and SE1_W3 of the impedance matching line 13*a*, a graph of changed VSWR is shown.

Referring to FIG. 12, it can be found that a frequency of the resonance is moved downwards in the resonance characteristics formed in 1.09 GHz and a frequency of the resonance is moved upwards in the resonance characteristics formed in 1.95 GHz. The reason why the frequency of the resonance formed in 1.09 GHz is moved downwards is because the impedance matching line 13*a* with an expanded line width is formed in an area in which the E-field distribution in 1.09 GHz is a maximum. The reason why the frequency of the resonance formed in 1.95 GHz is moved upwards is because the impedance matching line 13*a* with an expanded line width is formed in an area in which the H-field distribution in 1.95 GHz is a maximum. In summary, when the impedance matching line with the expanded line width is formed in the area in which E-field distribution is the maximum, downward movement of the frequency may be intended, and when the impedance matching line with the expanded line width is formed in the area in which H-field distribution is the maximum, upward movement of the frequency may be intended. The E-field and H-field distribution are different for each frequency, and therefore the frequency may be independently adjusted based on the E-field and H-field distribution in accordance with a frequency band desired to be adjusted. Such characteristics may be equally applied to the following description.

Figure 13:
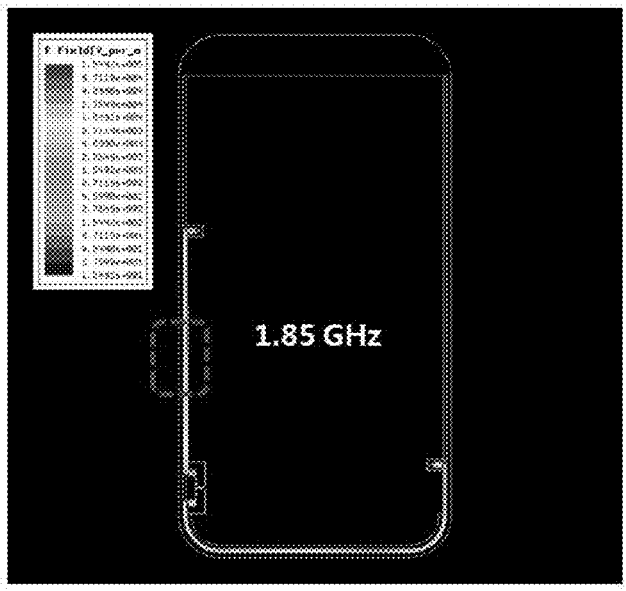
FIG. 13 is a view showing electric field distribution in 1.85 GHz with respect to the structure (a) of FIG. 7.
Figure 14:
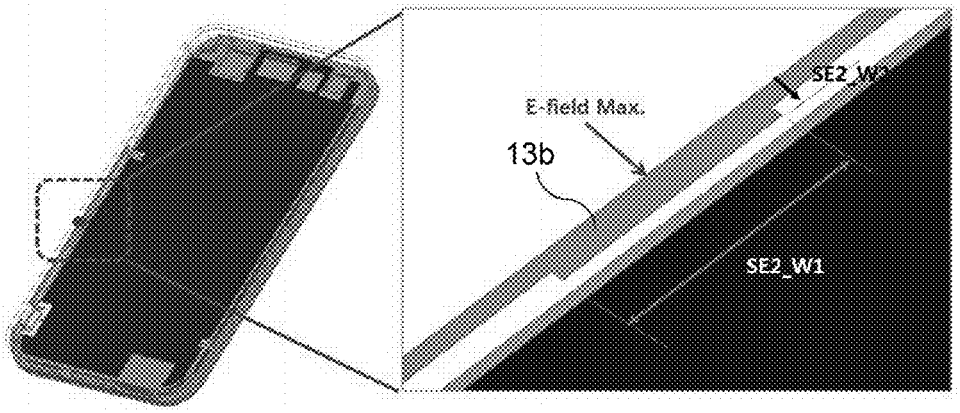
FIG. 14 is a view showing a state in which an impedance matching line is formed in an area verified in FIG. 13.
Figure 15:
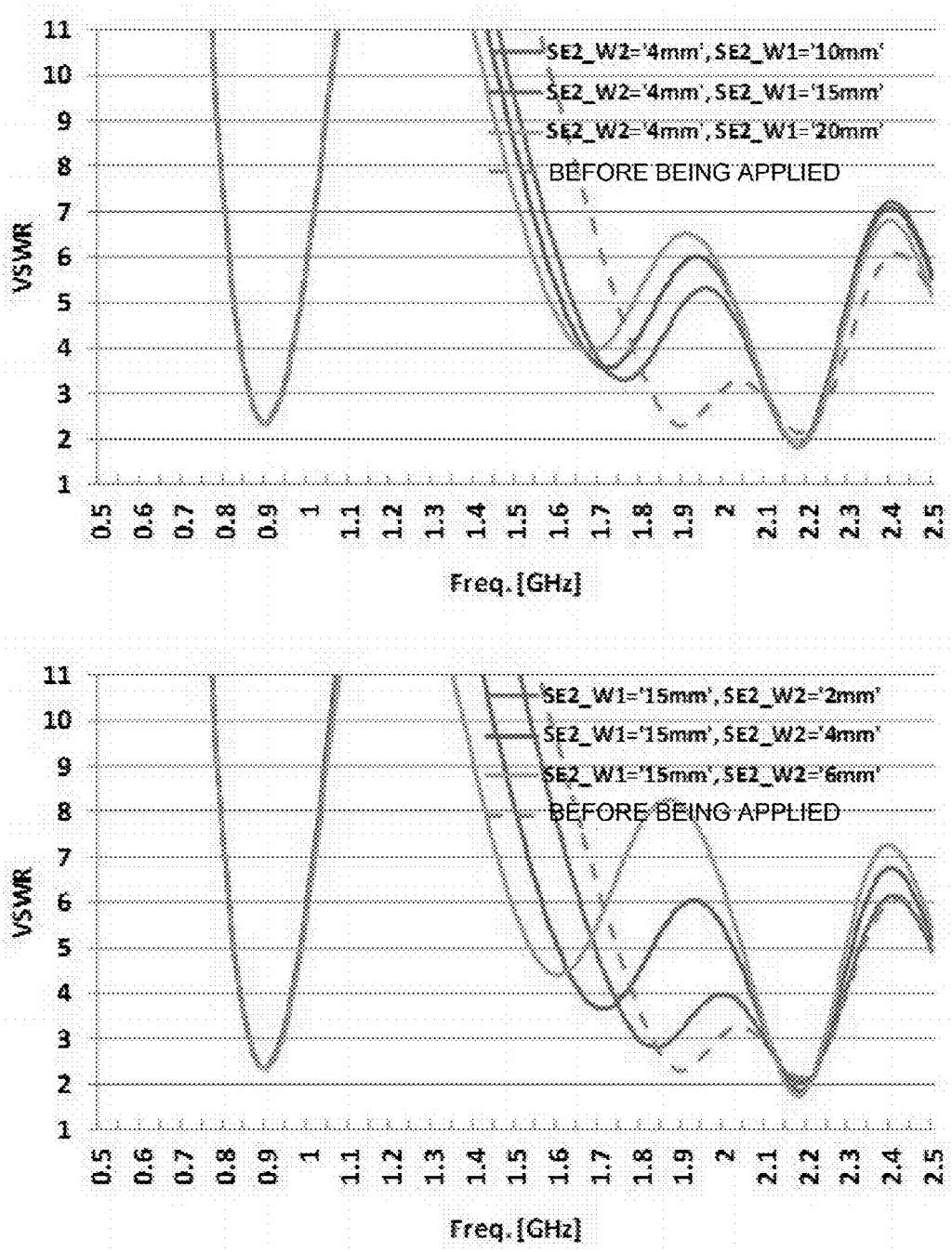
FIG. 15 is a graph showing VSWR that is changed by adjusting values of design parameters of the impedance matching line of FIG. 14.

FIG. 13 is a view showing electric field distribution in 1.85 GHz with respect to the structure (a) of FIG. 7. FIG. 14 is a view showing a state in which an impedance matching line is formed in an area verified in FIG. 13. In FIG. 15, by adjusting values of design parameters SE2_W1 and SE2_W2 of the impedance matching line 13*b*, a graph of changed VSWR is shown. Referring to FIG. 15, it can be found that a frequency is moved downwards in the resonance characteristics formed in 1.85 GHz. The reason why the frequency of the resonance formed in 1.85 GHz is moved downwards is because an impedance matching line 13*b* with an expanded line width is formed in an area in which E-field distribution in 1.85 GHz is a maximum.

Figure 16:
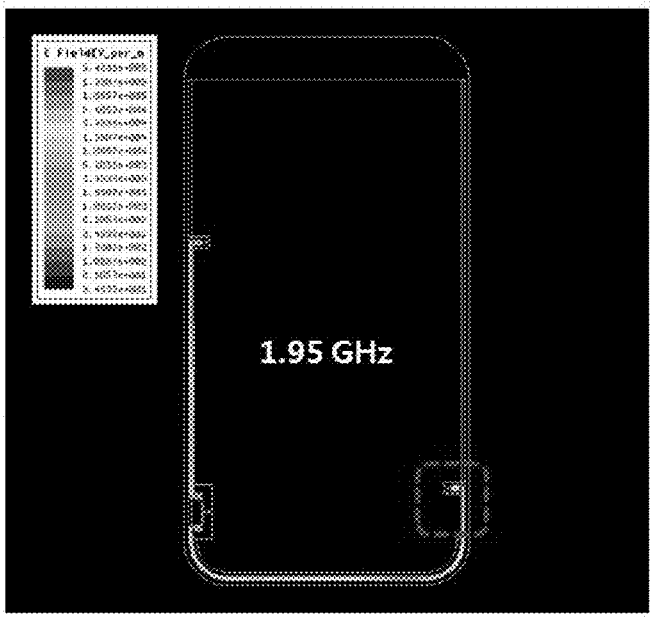
FIG. 16 is a view showing electric field distribution in 1.95 GHz with respect to the structure (a) of FIG. 7.
Figure 17:
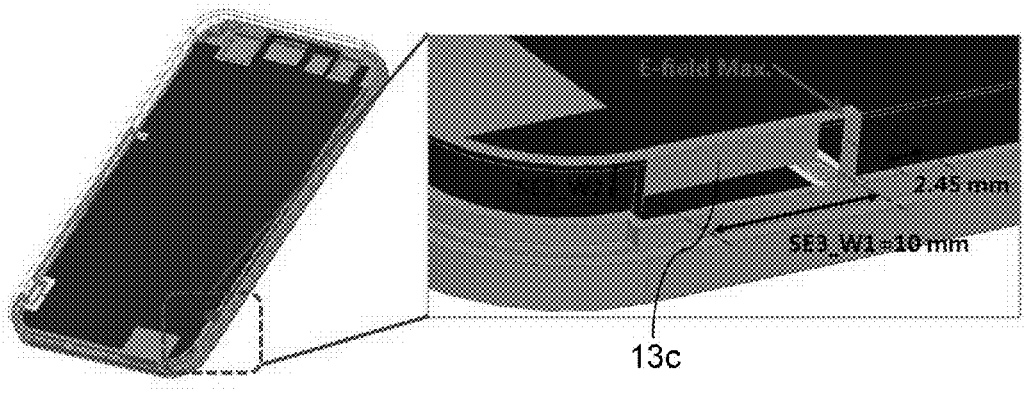
FIG. 17 is a view showing a state in which an impedance matching line is formed in an area verified in FIG. 16.
Figure 18:
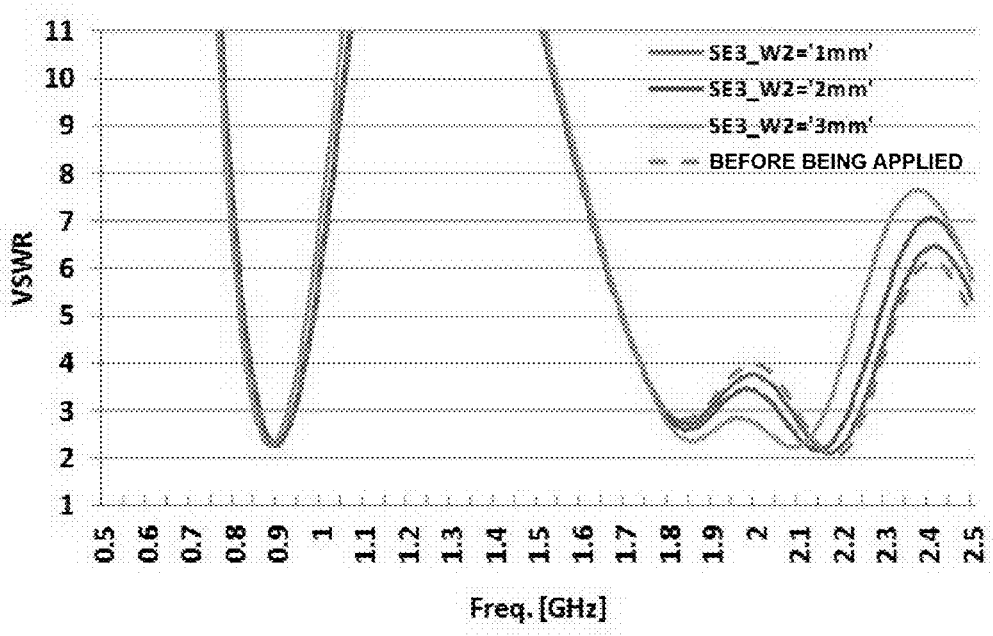
FIG. 18 is a graph showing VSWR that is changed by adjusting values of design parameters of the impedance matching line of FIG. 17.

FIG. 16 is a view showing electric field distribution in 1.95 GHz with respect to the structure (a) of FIG. 7. FIG. 17 is a view showing a state in which an impedance matching line is formed in an area verified in FIG. 16. In FIG. 18, a graph of VSWR changed by adjusting values of design parameters (fixed as SE3_W1=10 mm, only SE3_W2 is changed) of the impedance matching line 13*b* is shown. Referring to FIG. 18, it can be found that a frequency is moved downwards in the resonance characteristics formed in 1.95 GHz. The reason why the frequency of the resonance formed in 1.95 GHz is moved downwards is because an impedance matching line 13*c* with an expanded line width is formed in an area in which E-field distribution in 1.95 GHz is a maximum.

Figure 19:
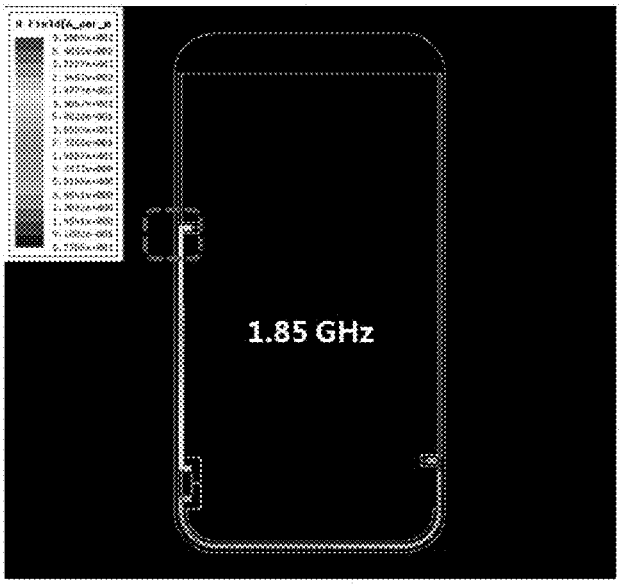
FIG. 19 is a view showing magnetic field distribution in 1.85 GHz with respect to the structure (a) of FIG. 7.
Figure 20:
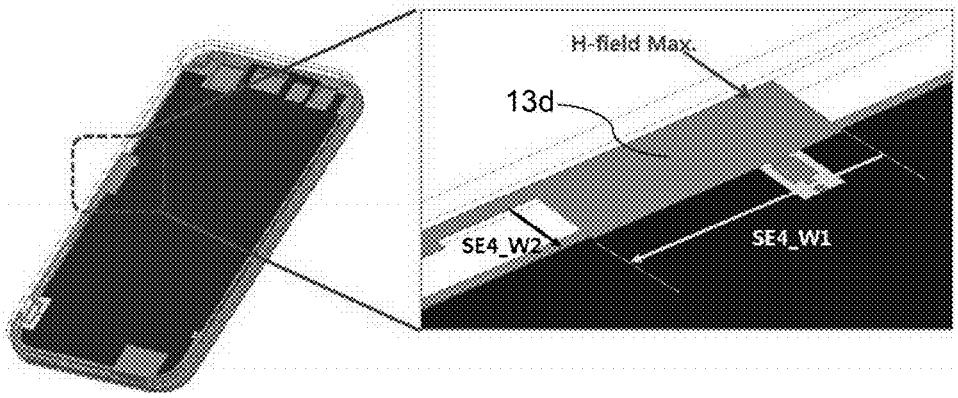
FIG. 20 is a view showing a state in which an impedance matching line is formed in an area verified in FIG. 19.
Figure 21:
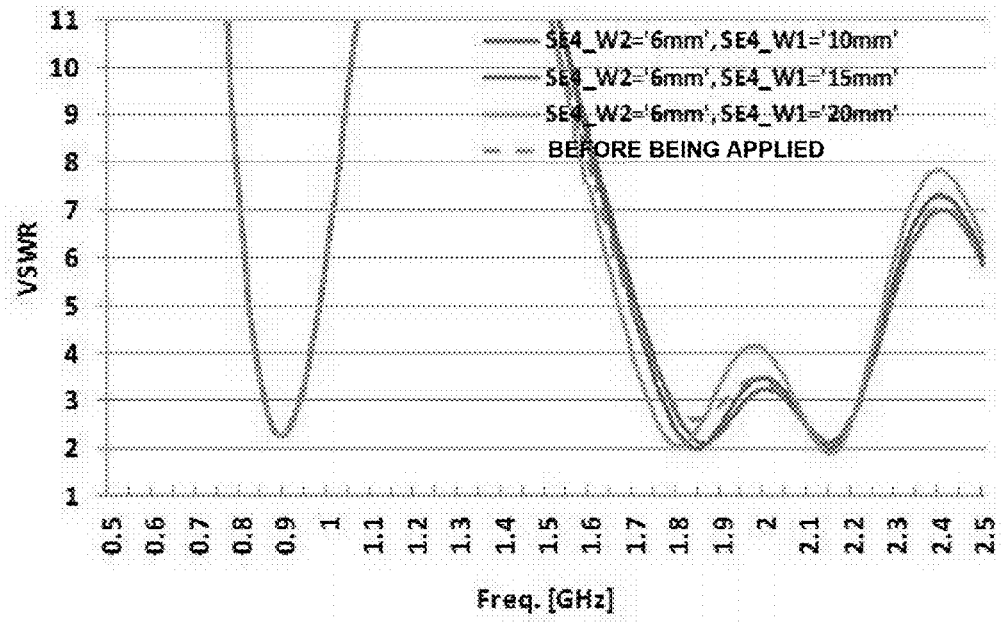
FIG. 21 is a graph showing VSWR that is changed by adjusting values of design parameters of the impedance matching line of FIG. 20.
Figure 21:
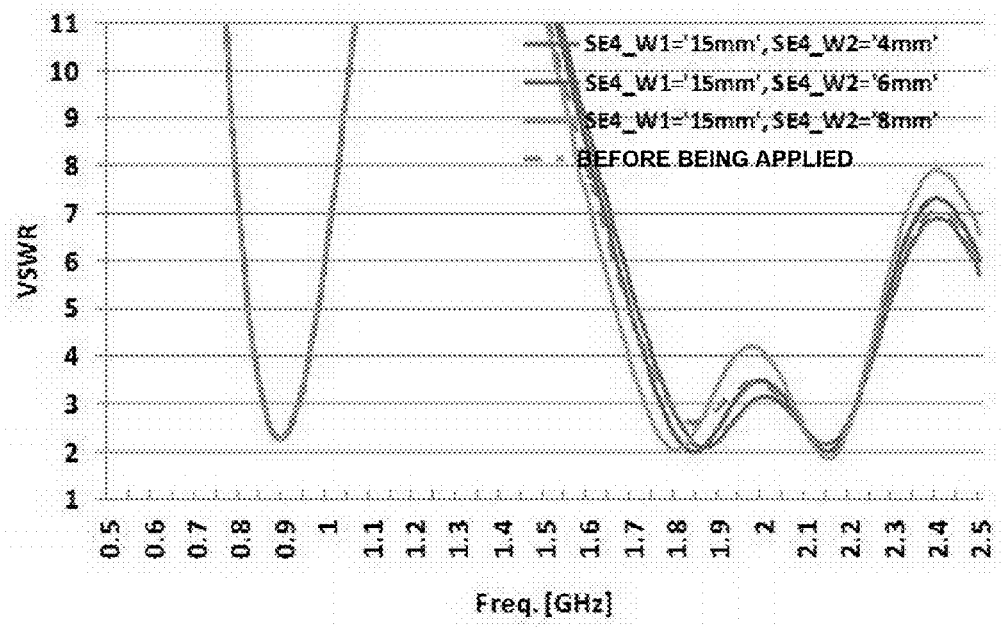

FIG. 19 is a view showing magnetic field distribution in 1.85 GHz with respect to the structure (a) of FIG. 7. FIG. 20 is a view showing a state in which an impedance matching line is formed in an area verified in FIG. 19. In FIG. 21, a graph of VSWR that is changed by adjusting values of design parameters SE4_W1 and SE4_W2 of an impedance matching line 13*d*. Referring to FIG. 21, it can be found that a frequency is moved downwards in the resonance characteristics formed in 1.85 GHz. When the impedance matching line with an expanded line width is formed in an area in which the H-field distribution is a maximum, characteristics in which a resonant frequency is moved upwards are exhibited, but the reason why the frequency is moved downwards in FIG. 21 is because an area in which the E-field distribution in 1.85 GHz is a maximum is adjacent. That is, it can be analyzed that the frequency is moved downwards because it is more greatly affected by the area described in FIGS. 13 to 15.

In this manner, by analyzing the E-field and H-field distributions according to each frequency, the antenna according to an embodiment of the present invention may move a resonant frequency band or increase a Q value. Thus, according to an embodiment of the present invention, the impedance matching line 13 may be formed in a point where the E-field or H-field distribution is a maximum within the first and second loop antennas 11 and 12.

When the antenna designer can intentionally adjust the E-field distribution characteristics of the antenna, the above-described characteristics may be more effectively utilized. Technology of adjusting an area in which the impedance matching line 13 is to be formed without separately considering the E-field distribution characteristics will be described.

Figure 22A:
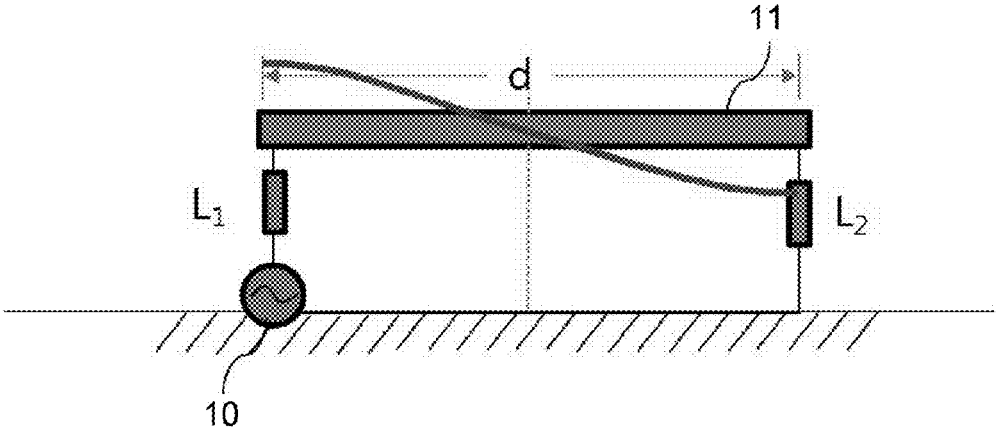
FIGS. 22A and 22B are views showing a state in which only a first loop antenna is separated from an antenna according to an embodiment of the present invention.
Figure 22B:
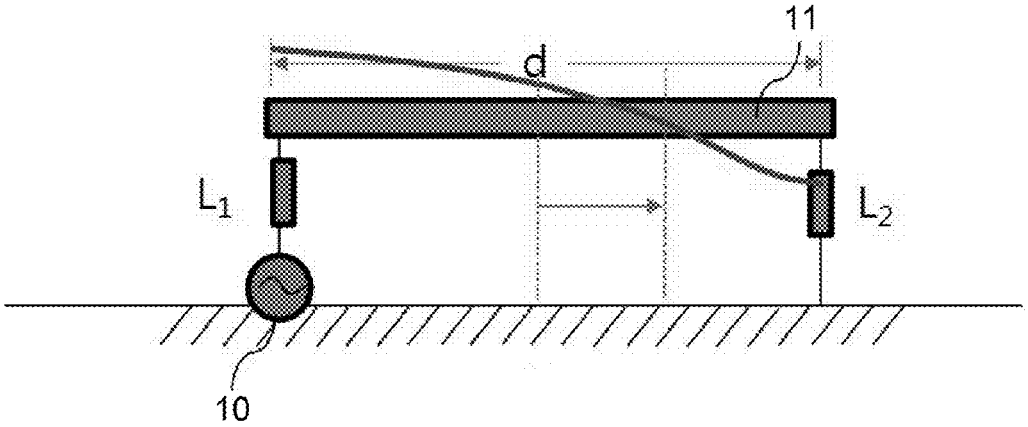
Figure 23A:
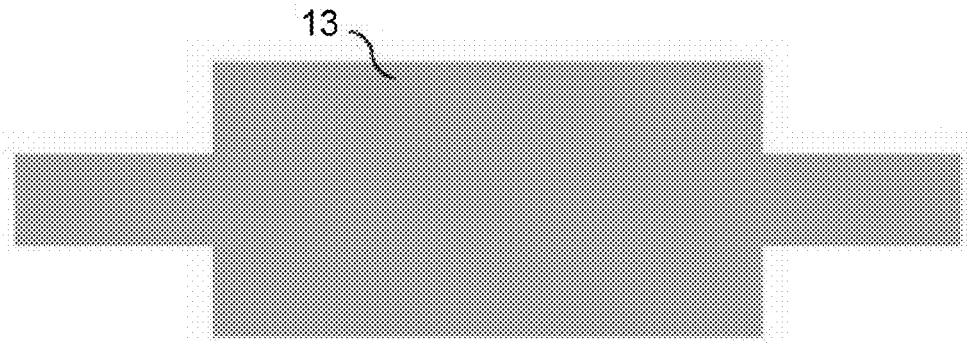
FIGS. 23A-23D are views showing various shapes of an impedance matching line.
Figure 23B:
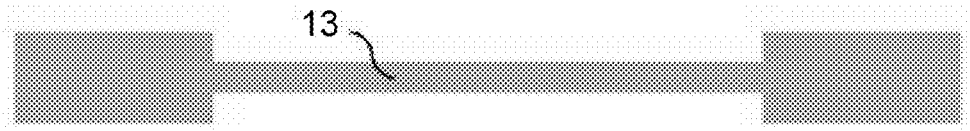
Figure 23C:
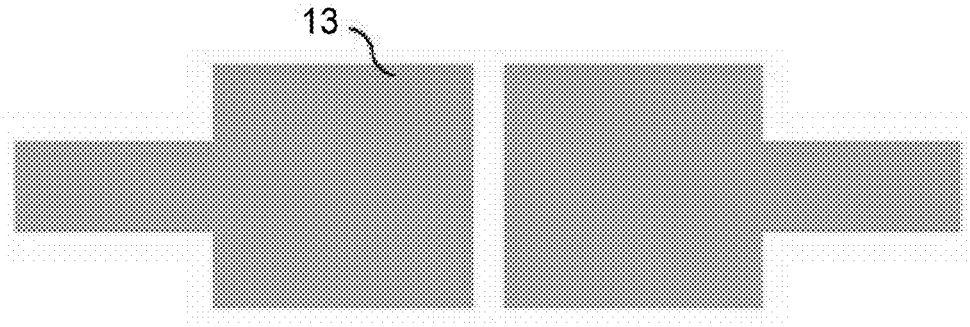
Figure 23D:
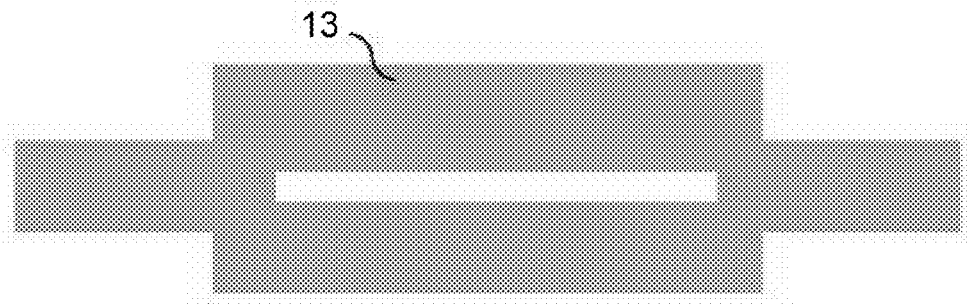

FIG. 22 is a view showing a state in which only the first loop antenna 11 is separated from an antenna according to an embodiment of the present invention, and is a view for describing a change in the E-field distribution in accordance with inductance components L1 and L2 of both ends of the first loop antenna 11.

Referring to FIG. 22, the inductance components L1 and L2 are included in the both ends of the first loop antenna 11. In other words, the first inductance component L1 is interposed between an end of the first loop antenna 11 and the feeder 10, and the second inductance component L2 is interposed between the other end of the first loop antenna 11 and the feeder 10.

In (a) of FIG. 22, a case in which values of the first and second inductance components L1 and L2 are the same is shown, and in this instance, an area in which the E-field distribution is a maximum is formed at the center of the first loop antenna 11.

In (b) of FIG. 22, a case in which the value of the second inductance component L2 is larger than the value of the first inductance component L1 is shown, and in this instance, the area in which the E-field distribution is the maximum is formed closer to the second inductance L2 side.

In this manner, even by understanding only a magnitude relationship of the first and second inductance components L1 and L2 applied to both ends of the first loop antenna 11, an area in which the E-field distribution is a maximum may be predicted in advance. When the impedance matching line 13 is formed in the area in which the E-field distribution is the maximum, it may more greatly affect tuning, and therefore, according to an embodiment of the present invention, the impedance matching line 13 is formed closer to one whose inductance value is larger than the other inductance component. In this case, even when the E-field distribution is not separately confirmed, the position of the impedance matching line 13 may be effectively determined.

Various embodiments of determining the position of the impedance matching line 13 in accordance with the inductance component applied to the both ends of the first loop antenna 11 will be described as below.

First, a first inductor is interposed between an end of the first loop antenna 11 and the feeder 10, and a second inductor is interposed between the other end of the first loop antenna 11 and the ground 20. When inductance values of the first and second inductors are different from each other, the impedance matching line 13 is formed closer to one whose inductance value is larger than the other inductor.

Second, the first inductor is interposed between the end of the first loop antenna 11 and the feeder 10, and the second inductor is interposed between the other end of the first loop antenna 11 and the ground 20. When the inductance values of the first and second inductors are the same, the impedance matching line is formed in an area including a center point of the first loop antenna 11.

Third, the first inductor is interposed between the end of the first loop antenna and the feeder 10. The other end of the first loop antenna 11 is directly connected to the ground 20.

In this case, the impedance matching line 13 is formed closer to the end of the first loop antenna 11 than the other end thereof.

Fourth, the second inductor is interposed between the other end of the first loop antenna 11 and the ground 20. The end of the first loop antenna 11 is directly connected to the feeder 10. In this case, the impedance matching line 13 is formed closer to the other end of the first loop antenna 11 than the end thereof.

FIG. 23 is a view showing various shapes of an impedance matching line.

As shown (a) of FIG. 23, the impedance matching line 13 may be formed in a shape in which a line width of the impedance matching line 13 is discontinuously expanded. As shown in (b) of FIG. 23, the impedance matching line 13 may be formed in a shape in which a line width of the impedance matching line 13 is discontinuously reduced. (a) and (b) of FIG. 23 have characteristics opposite to each other. When using the impedance matching line 13 whose line width is reduced as shown in (b) of FIG. 23, directivity of frequency movement has been described in FIGS. 3 to 21 may be shown inversely.

As shown in (c) of FIG. 23, a cap coupling structure may be included in the impedance matching line 13. As shown in (d) of FIG. 23, a slot may be included in the impedance matching line 13. In this manner, when including the gap coupling structure or the slot, changes may be given to inductance and capacitance components of the impedance matching line 13.

Figure 24:
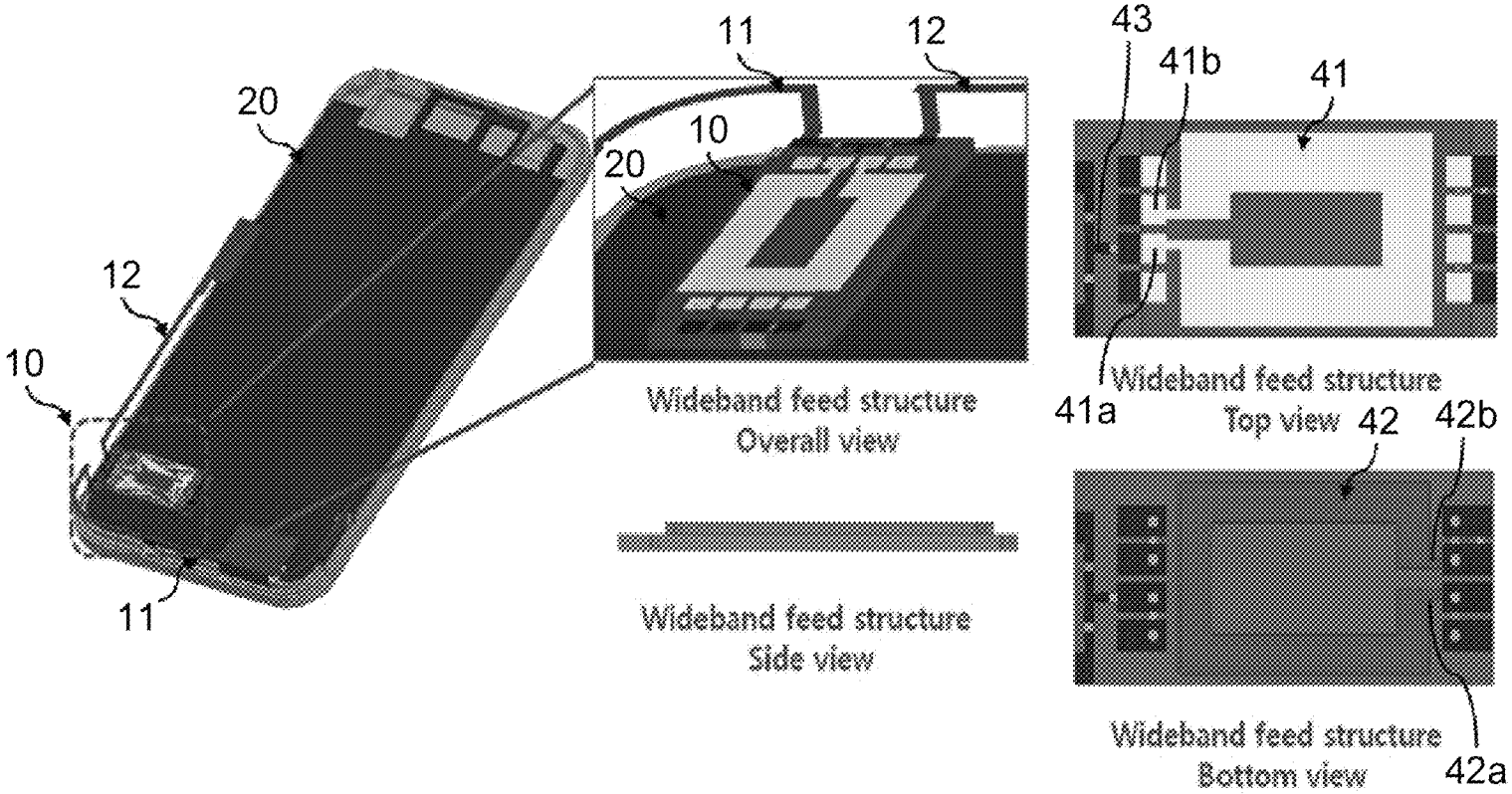
FIGS. 24 and 25 are views showing a state in which an antenna according to an embodiment of the present invention is coupled to a wideband feed structure to be applied.
Figure 25:
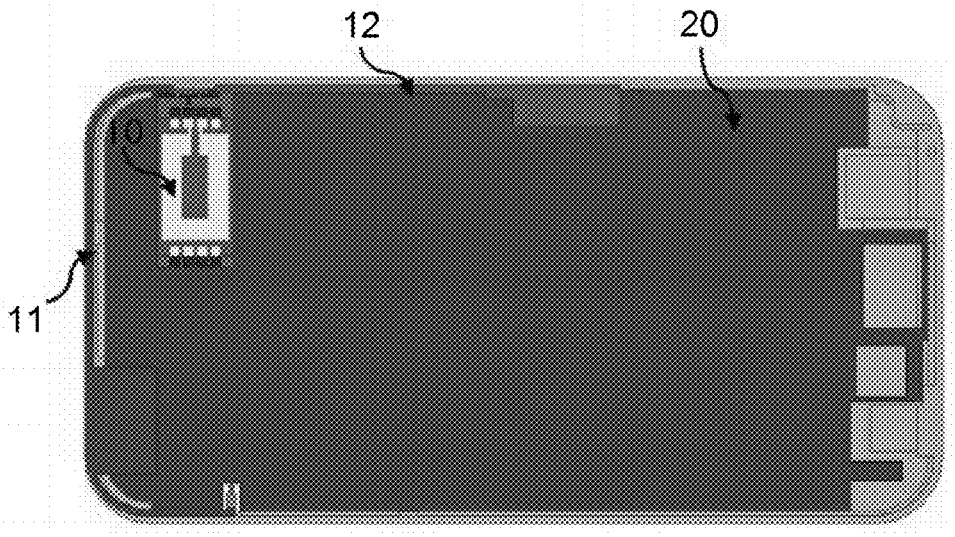

FIGS. 24 and 25 are views showing a state in which an antenna according to an embodiment of the present invention is coupled with a wideband feed structure to be applied. Referring to FIG. 24, the feeder 10 includes a branch line 43 that branches the first loop antenna 11 and the second loop antenna 12. A structure of the branch line 43 is formed in a T shape, but the shape of the branch line 43 is not limited thereto and is diversely changed.

Referring to FIG. 24, the feeder 10 includes a first feeder line 41 generally having a loop structure. The first feeder line 41 is connected to the branch line 43. Specifically, the first feeder line 41 has an end 41*a* connected to the branch line 43 and the other end 41*b* connected to the ground 20. The other end 41*b* of the first feeder line and the ground 20 may be connected via a via hole, or connected via a connection terminal or the like.

Referring to FIG. 24, the feeder 10 also includes a second feeder line 42 that generally has a loop structure and is inductively coupled to the first feeder line 41. The second feeder line 42 has an end 42*a* connected to a main circuit unit (not shown) and the other end 42*b* connected to the ground 20.

As shown in FIG. 24, the first feeder line 41 and the second feeder line 42 are respectively formed on different substrates, and a structure in which the substrates are laminated may be used.

According to such a structure, wideband matching of the antenna may be implemented through inductive coupling between the first feeder line 41 and the second feeder line 42, and consequently, an effect in which the bandwidth is expanded may be obtained. Such an effect will be described with reference to FIG. 26.

Figure 26:
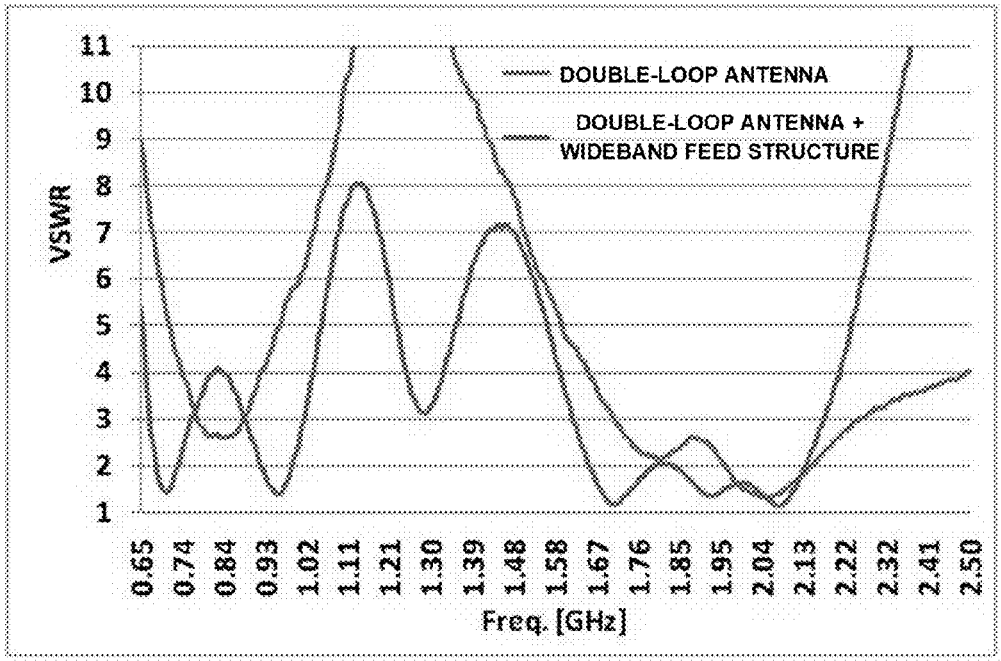
FIG. 26 is a graph showing VSWR that is measured in a state in which an antenna according to an embodiment of the present invention is coupled to a wideband feed structure.

FIG. 26 is a graph showing VSWR that is measured in a state in which an antenna according to an embodiment of the present invention is coupled to a wideband feed structure.

As shown in FIG. 26, it can be confirmed that the antenna is operated in a generally wide band in a case in which a double-loop antenna and a wideband feed structure are coupled together to be applied to the antenna, compared to a case in which only the double-loop antenna is applied. Thus, it is possible to cover a greater number of service bands.

The antenna according to various embodiments of the present invention described as above may be applied to the communication device. Here, the communication device should be understood as a concept including a general term for various electronic devices such as a laptop computer, a tablet computer, and the like as well as various handheld devices such as a mobile communication terminal, a smart phone, and the like.

As described above, according to the embodiments of the present invention, it is possible to provide a simple and clear design method of an antenna. That is, simply by adjusting an inductance component or an impedance matching line, the antenna may be easily designed.

In addition, according to the embodiments of the present invention, there is provided an antenna that can obtain excellent performance even without removing a ground plane of a main circuit included in a communication device. Thus, when such an antenna is provided, the main circuit included in the communication device may be utilized in a full ground state. As a result, a display area of the communication device may be expanded to the entire area of one surface of the communication device.

In addition, according to the embodiments of the present invention, there is provided an antenna which is less affected by hands compared to an existing inverted F-type or inverted L-type antenna due to Zeroth Order Resonance (ZOR) characteristics, and is resistant to interference of a deformed component.

It will be apparent to those skilled in the art that various modifications can be made to the above-described exemplary embodiments of the present invention without departing from the spirit or scope of the invention. Thus, it is intended that the present invention covers all such modifications provided they come within the scope of the appended claims and their equivalents.

What is claimed is:

1. An antenna comprising:

a feeder;

a first loop antenna that has an end connected to the feeder and the other end connected to a ground; and a second loop antenna that has an end connected to the feeder and the other end connected to the ground, and has an electrical length different from that of the first loop antenna, wherein an impedance matching line having a discontinuously different line width is formed in a partial area of the first loop antenna;

at least any one of the first and second loop antennas is formed in a rear cover of a communication device or on an inner side surface of a battery cover; and the feeder includes:

a branch line that branches the first loop antenna and the second loop antenna, a first feeder line that has a loop structure having an end connected to the branch line and the other end connected to the ground, and a second feeder line that has a loop structure having an end connected to a main circuit unit and the other end thereof to the ground, and is inductively coupled with the first feeder line.

2. The antenna of claim 1, wherein the ground is provided in the form of a full ground in which the ground is overlapped with the first and second loop antennas.

3. The antenna of claim 1, wherein the impedance matching line is formed in an area in which the impedance matching line is not overlapped with a deformed component.

4. The antenna of claim 1, wherein the impedance matching line is formed at a point at which electric field or magnetic field distribution is a maximum within the first and second loop antennas.

5. The antenna of claim 1, further comprising:

a first inductor that is interposed between the end of the first loop antenna and the feeder; and a second inductor that is interposed between the other end of the first loop antenna and the ground and has an inductance value different from that of the first inductor, wherein the impedance matching line is formed closer to one whose inductance value is larger than the other of the first and second inductors within the first loop antenna.

6. The antenna of claim 1, further comprising:

a first inductor that is interposed between the end of the first loop antenna and the feeder; and a second inductor that is interposed between the other end of the first loop antenna and the ground and has the same inductance value as that of the first inductor, wherein the impedance matching line is formed in an area including an intermediate point of the first loop antenna.

7. The antenna of claim 1, further comprising:

a first inductor that is interposed between the end of the first loop antenna and the feeder, wherein the impedance matching line is formed closer to the one end than the other end between the one and other ends of the first loop antenna.

8. The antenna of claim 1, further comprising:

a second inductor that is interposed between the other end of the first loop antenna and the ground, wherein the impedance matching line is formed closer to the other end than the one end between the one and other ends of the first loop antenna.

9. The antenna of claim 1, wherein a gap coupling structure is included in the impedance matching line.

10. The antenna of claim 1, wherein a slot is included in the impedance matching line.

11. A communication device including the antenna according to claim 1.

* * * * *